US012366427B2

(12) United States Patent
Hemphill et al.

(10) Patent No.: US 12,366,427 B2
(45) Date of Patent: Jul. 22, 2025

(54) BUFFER TUBE INSERT AND METHOD OF USING THE SAME

(71) Applicants: W. Scott Hemphill, Wilmington, DE (US); Austin T. Bender, North East, MD (US); M. Scott McCormick, Newark, DE (US)

(72) Inventors: W. Scott Hemphill, Wilmington, DE (US); Austin T. Bender, North East, MD (US); M. Scott McCormick, Newark, DE (US)

( * ) Notice: Subject to any disclaimer, the term of this patent is extended or adjusted under 35 U.S.C. 154(b) by 36 days.

(21) Appl. No.: 18/206,682

(22) Filed: Jun. 7, 2023

(65) Prior Publication Data

US 2023/0324139 A1 Oct. 12, 2023

Related U.S. Application Data

(63) Continuation of application No. 29/775,991, filed on Mar. 26, 2021, now Pat. No. Des. 1,050,336, and a continuation of application No. 29/775,993, filed on Mar. 26, 2021, now Pat. No. Des. 1,047,066.

(51) Int. Cl.
*F41C 23/06* (2006.01)
*F41A 3/78* (2006.01)

(52) U.S. Cl.
CPC ..... *F41C 23/06* (2013.01); *F41A 3/78* (2013.01)

(58) Field of Classification Search
CPC ..... F41C 23/06; F41A 3/78
See application file for complete search history.

(56) References Cited

U.S. PATENT DOCUMENTS

| | | | | |
|---|---|---|---|---|
| 5,031,348 | A * | 7/1991 | Carey | F41C 23/14 42/74 |
| 5,235,764 | A * | 8/1993 | Perazzi | F41C 23/14 42/73 |
| 6,651,371 | B2 | 11/2003 | Fitzpatrick et al. | |
| 7,762,018 | B1 * | 7/2010 | Fitzpatrick | F41C 23/22 42/73 |
| 7,823,313 | B2 * | 11/2010 | Faifer | F41C 23/06 42/1.06 |
| 7,849,626 | B2 * | 12/2010 | Fluhr | F41C 23/04 42/73 |
| 8,397,414 | B2 * | 3/2013 | Walters | F41C 23/20 89/158 |
| 8,434,252 | B2 * | 5/2013 | Holmberg | F41A 3/84 42/1.06 |
| 8,943,726 | B2 * | 2/2015 | Kincel | F41C 23/06 42/1.06 |
| 9,551,549 | B1 * | 1/2017 | Chvala | F41C 7/00 |
| 9,927,206 | B1 * | 3/2018 | Smith | F41C 23/16 |
| 10,012,470 | B2 * | 7/2018 | Johnson | F41C 23/20 |
| 10,088,268 | B2 | 10/2018 | Hewes et al. | |

(Continued)

*Primary Examiner* — Michelle Clement
(74) *Attorney, Agent, or Firm* — UB Greensfelder LLP; Brian E. Turung

(57) ABSTRACT

A buffer tube insert includes an elongated portion and one or more projections extending from the elongated portion. The one or more projections are configured for insertion into one or more corresponding notches on a buffer tube. Each projection includes a connection arrangement such as, but not limited to, a threaded interior for receiving a connection member such as, but not limited to, a set screw that can facilitate the restriction of movement between the buffer tube and a gunstock.

15 Claims, 3 Drawing Sheets

(56) References Cited

U.S. PATENT DOCUMENTS

| | | | | |
|---|---|---|---|---|
| 10,345,060 | B2 * | 7/2019 | Irvin | F41C 23/20 |
| 10,393,475 | B2 * | 8/2019 | Keller | F41C 23/20 |
| 10,551,144 | B2 * | 2/2020 | Overstreet | F41C 23/14 |
| 11,112,209 | B2 * | 9/2021 | Overstreet | F41C 23/14 |
| 11,703,304 | B2 * | 7/2023 | Hannah | F41A 3/84 42/71.01 |
| 11,740,041 | B2 * | 8/2023 | Vanek | F41C 23/20 89/199 |
| 11,740,050 | B2 * | 8/2023 | Alomaira | F41C 23/14 42/71.01 |
| D1,047,066 | S * | 10/2024 | Hemphill | D22/199 |
| D1,050,336 | S * | 11/2024 | Hemphill | D22/199 |
| 2010/0050492 | A1 | 3/2010 | Faifer | |
| 2010/0229444 | A1 * | 9/2010 | Faifer | F41C 23/04 42/1.06 |
| 2018/0066916 | A1 * | 3/2018 | Olsen | F41C 23/14 |
| 2019/0049213 | A1 * | 2/2019 | Yang | F41C 23/14 |
| 2020/0386508 | A1 | 12/2020 | Gomez | |
| 2022/0057167 | A1 * | 2/2022 | Lehr | F41C 23/20 |
| 2022/0290944 | A1 * | 9/2022 | Lehr | F41C 23/20 |

* cited by examiner

BUFFER TUBE INSERT AND METHOD OF USING THE SAME

REFERENCE TO RELATED APPLICATIONS

The present application claims the priority benefit of U.S. Design application Ser. No. 29/775,991, entitled BUFFER TUBE INSERT, filed Mar. 26, 2021, and U.S. Design application Ser. No. 29/775,993, entitled BUFFER TUBE INSERT, filed Mar. 26, 2021, and hereby incorporates the same applications herein by reference in their entireties.

TECHNICAL FIELD

The present application relates to a buffer tube insert for a firearm and methods for using the same. More specifically, the present application relates to a buffer tube insert for restricting movement of a gunstock.

BACKGROUND OF DISCLOSURE

Conventional rifles and other firearms are known to include a buffer tube housed within a gunstock. Buffer tubes, employed at a rear end of the firearms action, not only house mechanical components necessary (but not always) for the firing of weapon, but also are utilized as a means of securing a collapsible/adjustable gunstock. Specifically, the buffer tube can facilitate in the ejection of a spent cartridge case, upon compression of a buffer spring, before retrieval of a new cartridge from a magazine upon closure. A gunstock may be collapsible to allow users to adjust an overall length of the same. However, such collapsible gunstocks may be unlawful in certain jurisdictions.

In view of the correct state of firearms, there is a need for a mechanism for easily and conveniently converting a collapsible gunstock to a fixed gunstock in order to comply with various regional regulations.

SUMMARY OF DISCLOSURE

In accordance with one non-limiting aspect of the present disclosure, there is provided a buffer tube insert for a firearm and methods for using the same. The buffer tube insert in accordance with the present disclosure is not limited to any one type of firearm. In one non-limiting embodiment, the buffer tube insert in accordance with the present disclosure is configured to restrict movement of a gunstock of a firearm. The buffer tube insert of the present disclosure is configured easily and conveniently converting a collapsible gunstock to a fixed gunstock.

In accordance with another and/or alternative non-limiting aspect of the present disclosure, there is provided a buffer tube insert that comprises an elongated portion; and a plurality of projections extending from the elongated portion, and wherein one or more or all of the projections including a threaded interior. One or more or all of the projections are configured for insertion into one or more corresponding notches on the buffer tube.

In accordance with another and/or alternative non-limiting aspect of the present disclosure, there is provided a gunstock assembly that comprises a collapsible gunstock including an adjustment mechanism, a buffer tube slidably housed within the collapsible gunstock, a buffer tube insert, and a set screw. The buffer tube comprises an elongated tube portion; and a flat portion affixed to an outer portion of the buffer tube. The flat portion includes a track defined by two rails extending along at least a portion of a length of the elongated tube portion; and a plurality of notches arranged in series along at least a portion of a length of the flat portion between the two rails. The buffer tube insert comprises an elongated portion; and a plurality of projections extending from the elongated portion, and wherein one or more or all of the projections including a threaded interior. One or more or all of the projections are configured for insertion into one or more corresponding notches on a buffer tube. A set screw can be provided that is configured for insertion into the adjustment mechanism and the threaded connection with one of the plurality of projections of the buffer tube insert.

In accordance with another and/or alternative non-limiting aspect of the present disclosure, there is provided a method of using a buffer tube insert comprises positioning a buffer tube insert between rails extending from a buffer tube slidably housed within a gunstock, wherein the buffer tube insert comprises an elongated portion; and a plurality of projections extending from the elongated portion, and wherein one or more or all of the projections including a threaded interior. One or more or all of the projections are configured for insertion into one or more corresponding notches on a buffer tube. The method further comprises axially adjusting a position of the gunstock relative to the buffer tube insert such that an aperture of the adjustment mechanism aligns with the threaded interior of one of the plurality of projections of the buffer tube insert. The method further comprises securing a set screw extending through the aperture of the adjustment mechanism within the threaded interior of one of the projections of the buffer tube insert.

One non-limiting object of the present disclosure is the provision of a buffer tube insert that can be used to easily and conveniently converting a collapsible gunstock to a fixed gunstock.

Another and/or alternative object of the present disclosure is the provision of a buffer tube insert that is configured to be removably connected to a buffer tube of a firearm.

Another and/or alternative object of the present disclosure is the provision of a buffer tube insert that comprises an elongated portion and a plurality of projections extending from the elongated portion.

Another and/or alternative object of the present disclosure is the provision of a buffer tube insert that comprises an elongated portion and a plurality of projections extending from the elongated portion, and wherein one or more or all of the projections include a connection arrangement such as, but not limited to a threaded interior, a locking slot arrangement, snap arrangement, pin arrangement, twist lock arrangement, quick release arrangement, a barb arrangement, etc.

Another and/or alternative object of the present disclosure is the provision of a buffer tube insert that comprises an elongated portion and a plurality of projections extending from the elongated portion, and wherein one or more or all of the projections are configured for insertion in one or more corresponding notches on a buffer tube of a fire arm.

Another and/or alternative object of the present disclosure is the provision of a buffer tube insert that comprises an elongated portion and a plurality of projections extending from the elongated portion, and wherein one or more or all of the projections are cylindrical-shaped or substantially cylindrical-shaped.

Another and/or alternative object of the present disclosure is the provision of a buffer tube insert that comprises an elongated portion and a plurality of projections extending from the elongated portion, and wherein one or more or all of the projections are arranged in series along a length of the elongated portion of the buffer tube insert.

Another and/or alternative object of the present disclosure is the provision of a buffer tube insert that comprises an elongated portion and 1-8 projections (and all values and ranges therebetween) that extend from the elongated portion.

Another and/or alternative object of the present disclosure is the provision of a buffer tube insert that comprises an elongated portion and a plurality of projections extending from the elongated portion, and wherein one or more or all of the projections are configured to receive a set screw or set pin.

Another and/or alternative object of the present disclosure is the provision of a buffer tube insert that is configured to be received or inserted between rails extending from the buffer tube of a firearm.

Another and/or alternative object of the present disclosure is the provision of a buffer tube insert that is configured to be received or inserted between rails extending from the buffer tube of a firearm, and wherein the rails extend from an underside of the buffer tube.

Another and/or alternative object of the present disclosure is the provision of a buffer tube insert that is partially or fully formed of a durable material (e.g., plastic, carbon fiber material, resin material, metal, ceramic material, etc.).

Another and/or alternative object of the present disclosure is the provision of a buffer tube insert that is partially or fully formed of a steel and/or titanium.

Another and/or alternative object of the present disclosure is the provision of a gunstock assembly that comprises a) a collapsible gunstock including an adjustment mechanism; b) a buffer tube that is slidably housed within the collapsible gunstock; and c) a buffer tube insert that is connectable to the buffer tube, and wherein said buffer tube is configured to inhibit or prevent slidable movement of the buffer tube in the collapsible gunstock when the buffer tube insert is connected to the buffer tube.

Another and/or alternative object of the present disclosure is the provision of a gunstock assembly that comprises a) a collapsible gunstock including an adjustment mechanism; b) a buffer tube that is slidably housed within the collapsible gunstock; and c) a buffer tube insert that is releasably connectable to the buffer tube, and wherein said buffer tube is configured to inhibit or prevent slidable movement of the buffer tube in the collapsible gunstock when the buffer tube insert is connected to the buffer tube.

Another and/or alternative object of the present disclosure is the provision of a gunstock assembly that comprises a) a collapsible gunstock including an adjustment mechanism; b) a buffer tube that is slidably housed within the collapsible gunstock; and wherein the buffer tube includes i) an elongated tube portion, ii) a flat portion affixed to an outer surface of the buffer tube, iii) the flat portion including a track defined by at least two rails extending along at least a portion of a length of the elongated tube portion; and iv) the flat portion including two or more notches arranged in series along at least a portion of a length of the flat portion between the at least two rails; and c) a buffer tube insert that is connectable to the buffer tube, and wherein the buffer tube is configured to inhibit or prevent slidable movement of the buffer tube in the collapsible gunstock when the buffer tube insert is connected to the buffer tube.

Another and/or alternative object of the present disclosure is the provision of a gunstock assembly that comprises a) a collapsible gunstock including an adjustment mechanism; b) a buffer tube that is slidably housed within the collapsible gunstock; and wherein the buffer tube includes i) an elongated tube portion, ii) a flat portion affixed to an outer surface of the buffer tube, iii) the flat portion including a track defined by at least two rails extending along at least a portion of a length of the elongated tube portion; and iv) the flat portion including two or more notches arranged in series along at least a portion of a length of the flat portion between the at least two rails; and c) a buffer tube insert that is connectable to the buffer tube, and wherein said buffer tube is configured to inhibit or prevent slidable movement of the buffer tube in the collapsible gunstock when the buffer tube insert is connected to the buffer tube, and wherein the buffer tube insert includes i) an elongated portion, and ii) one or more projections extending from the elongated portion, each projection including a connection arrangement (threaded interior, a locking slot arrangement, snap arrangement, pin arrangement, twist lock arrangement, quick release arrangement, a barb arrangement, etc.), and wherein one or more of the projections are configured for partial or full insertion in the one or more notches on the buffer tube.

Another and/or alternative object of the present disclosure is the provision of a gunstock assembly that comprises a) a collapsible gunstock including an adjustment mechanism; b) a buffer tube that is slidably housed within the collapsible gunstock; and wherein the buffer tube includes i) an elongated tube portion, ii) a flat portion affixed to an outer surface of the buffer tube, iii) the flat portion including a track defined by at least two rails extending along at least a portion of a length of the elongated tube portion; and iv) the flat portion including two or more notches arranged in series along at least a portion of a length of the flat portion between the at least two rails; c) a buffer tube insert that is connectable to the buffer tube, and wherein said buffer tube is configured to inhibit or prevent slidable movement of the buffer tube in the collapsible gunstock when the buffer tube insert is connected to the buffer tube, and wherein the buffer tube insert includes i) an elongated portion, and ii) one or more projections extending from the elongated portion, each projection including a connection arrangement (e.g., threaded interior, a locking slot arrangement, snap arrangement, pin arrangement, twist lock arrangement, quick release arrangement, a barb arrangement, etc.), and wherein one or more of the projections are configured for partial or full insertion in the one or more notches on the buffer tube; and d) a connection member (e.g., set screw, pin, etc.) configured for insertion into the adjustment mechanism and the connection arrangement of one of the projections of the buffer tube insert.

Another and/or alternative object of the present disclosure is the provision of a method of using a buffer tube insert comprising a) positioning a buffer tube insert in a buffer tube of a firearm, and b) securing the buffer tube insert to buffer tube; and wherein the buffer tube is configured to inhibit or prevent slidable movement of the buffer tube in a collapsible gunstock when the buffer tube insert is connected to the buffer tube.

Another and/or alternative object of the present disclosure is the provision of a method of using a buffer tube insert comprising a) positioning a buffer tube insert in a buffer tube of a firearm, and b) releasably securing the buffer tube insert to buffer tube; and wherein the buffer tube is configured to inhibit or prevent slidable movement of the buffer tube in a collapsible gunstock when the buffer tube insert is connected to the buffer tube and another portion of the firearm.

Another and/or alternative object of the present disclosure is the provision of a method of using a buffer tube insert comprising a) positioning a buffer tube insert in a buffer tube of a firearm, b) securing the buffer tube insert to buffer tube, c) axially adjusting a position of the gunstock of a firearm to the buffer tube such that an aperture of an adjustment mechanism aligns with a portion of the buffer tube insert, and d) connecting the adjustment mechanism to the buffer tube insert; and wherein the buffer tube is configured to inhibit or prevent slidable movement of the buffer tube in the collapsible gunstock when the buffer tube insert is connected to the buffer tube and the adjustment arrangement.

Other objects, advantages, and novel features of the present invention will become apparent from the following detailed description of the invention when considered in conjunction with the accompanying drawings.

BRIEF DESCRIPTION OF THE DRAWINGS

The following is a brief description of the drawings, which are presented for the purposes of illustrating the exemplary embodiments disclosed herein and not for the purposes of limiting the same.

DESCRIPTION OF NON-LIMITING EMBODIMENTS

Figure 1:
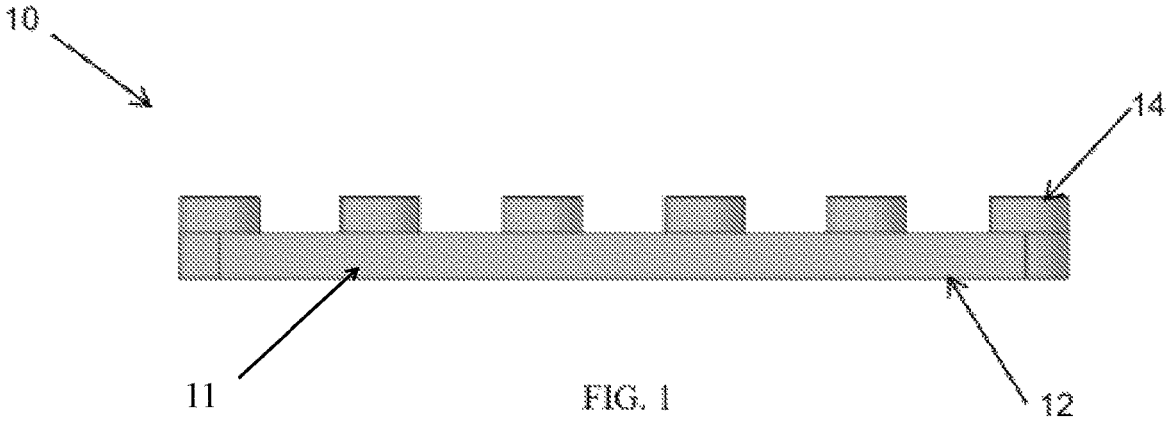
FIG. 1 depicts a side plan view of a buffer tube insert according to one embodiment.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g., "about 2 to about 4" also discloses the range "from 2 to 4." Generally, the terms "about" and "approximately" may refer to plus or minus 10% of the indicated number.

Figure 2:
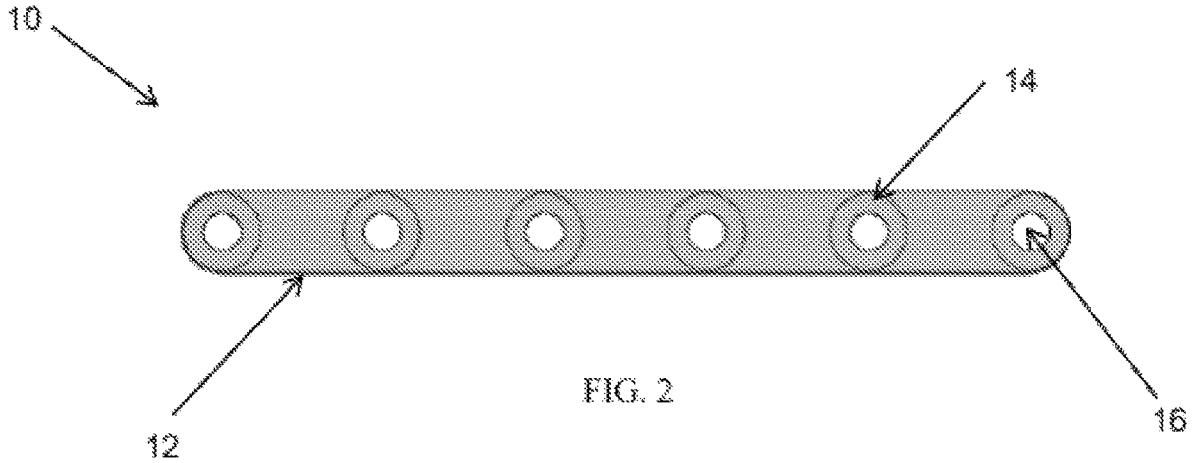
FIG. 2 depicts a top plan view of the buffer tube insert of FIG. 1.
Figure 3:
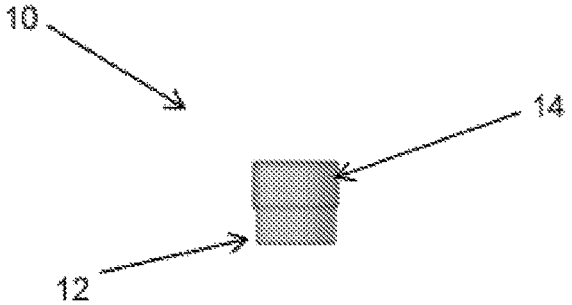
FIG. 3 depicts an end plan view of the buffer tube insert of FIG. 1.

As will be described herein, buffer tube inserts in accordance with the present disclosure are disclosed that can be used to convert a collapsible gunstock to a fixed gunstock. Gunstock assemblies including buffer tube inserts are also disclosed. As shown in FIGS. 1-3, a buffer tube insert 10 can include can include an elongated portion 12 and a plurality of projections 14 extending from the elongated portion. Each of the plurality of projections 14 can include a threaded interior 16. As can be appreciated, cavity of the projections 14 can include other interior configurations (e.g., a locking slot arrangement, snap arrangement, pin arrangement, twist lock arrangement, quick release arrangement, a barb arrangement, etc.).

In certain embodiments, and as shown in FIGS. 1-3, the projections 14 can be arranged in series along a length of the elongated portion 12, and in such embodiments, the projections 14 can be located at each end thereof. In certain embodiments, the buffer tube insert 10 can include six projections 14. It will be appreciated, however, that any suitable number of projections can be employed in any of a variety of configurations of a buffer insert tube. As such, the buffer tube insert 10 can include one or more projections 14 (e.g., 1-10+ and all values and ranges therebetween), and the buffer insert tube can be accordingly configured to include the same number, a smaller number or greater number of projections 14 as the number of guide notches 18 on a buffer tube 20. The longitudinal length of the buffer tube insert 10 can be the same length, a longer length or a shorter length than the buffer tube 20. The width of the of the buffer tube insert 10 can be the same width, a larger width or a smaller width than the buffer tube 20.

The buffer tube insert 10 can be configured for use with commercial buffer tubes or any conventional type of buffer tubes of firearms. In certain non-limiting embodiments, the body 11 of the buffer tube insert 10 includes plurality of projections 14. The number of projections 14 are non-limiting. As illustrated in FIG. 1, the buffer tube insert 10 has six (6) projections 14. The number of the projections 14 are generally the same as or less than the number of guide notches 18 on a buffer tube 20. The spacing of two or more adjacently positioned projections 14 are generally the same as the spacing of the guide notches 18 on the buffer tube 20; however this is not required.

The projections 14 are configured for insertion in corresponding position guide notches 18 on a buffer tube 20. As shown on the conventional buffer tube 20 depicted in FIG. 4, the guide notches 18 are cylindrically-shaped and arranged in series. As can be appreciated, the guide notches can have a different shape. Thus, in certain embodiments, each of the plurality of projections 14 can be cylindrical, as shown in FIGS. 1-5, such that the projections 14 can be configured to be effectively received by the notches 18. It will be appreciated, however, that while the projections 14 and notches 18 depicted in, for example, FIGS. 1-5 are shown to be cylindrical and arranged in series, projections and notches may be provided as cylindrical, substantially cylindrical, or in any of a variety of suitable shapes or configurations, such that the projections can be effectively received within the notches. Generally, the shape of the projections 14 is the same as the shape of the guide notches 18; however, this is not required.

Figure 6:
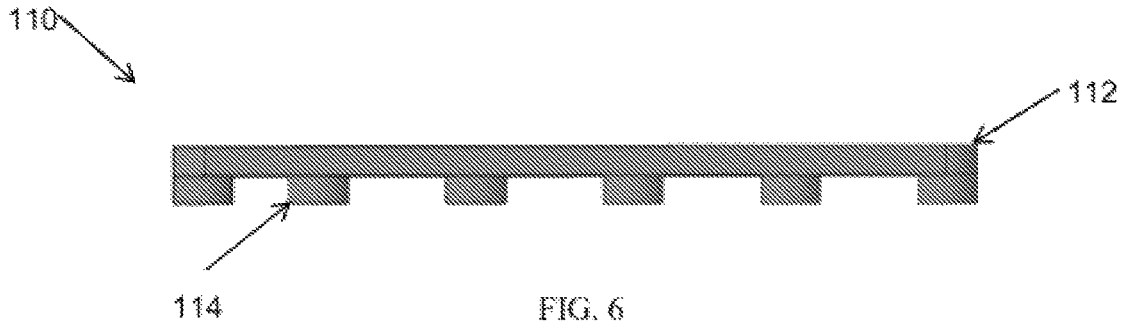
FIG. 6 depicts a side plan view of an buffer tube insert according to another embodiment.
Figure 7:
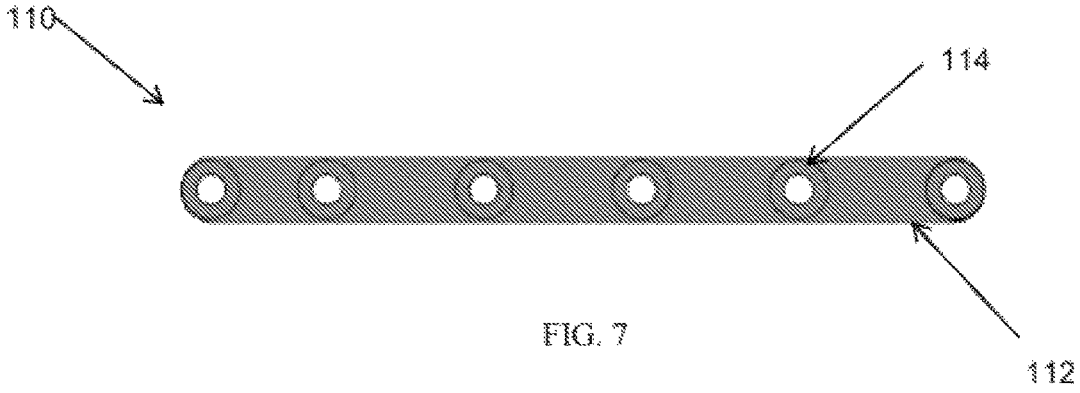
FIG. 7 depicts a top plan view of the buffer tube insert of FIG. 6.

In one non-limiting embodiment, the buffer tube insert 10 can have a length of about 90.75 mm and a width of about 8.00 mm to about 8.40 mm and the elongated portion 12 can have a height of about 4.35 mm and each of the projections 14 can have a height of about 3.5 mm, such that a height of the buffer tube insert 10 can be about 4.35 mm or about 7.85 mm along the length of the same. The diameter of the projections 14 can be about 8.00 mm to about 8.40 mm, and the diameter of the threaded interior 16 of the projection 14 can be about 4.00 mm. In such embodiment, a length between longitudinal axes of adjacent projections 14 can be about 16.55 mm. While the lengths between the longitudinal axes of adjacent projections 14 can be the same along the length of the buffer tube insert 10, as shown in FIGS. 1 and 2, it will be appreciated that, in other embodiments, lengths between longitudinal axes of adjacent projections can vary along a length of a buffer tube insert 110, as shown in FIGS. 6 and 7. As can be appreciated, the projections 14 can have a connection arrangement other than a threaded interior 16. Such other connection arrangements can include a slotted locking arrangement, a locking slot arrangement, snap arrangement, pin arrangement, twist lock arrangement, quick release arrangement, a barb arrangement, etc.

Figure 8:
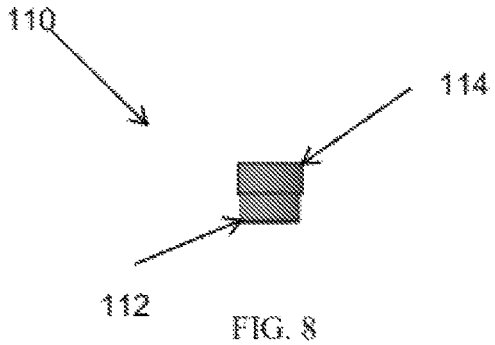
FIG. 8 depicts an end plan view of the buffer tube insert of FIG. 6.

In another non-limiting embodiment, such as that shown in FIGS. 6-8, the elongated portion 112 can have a height of about 3.75 mm and each of the projections 114 can have a height of about 3.5 mm, such that a height of the buffer tube insert 110 can be about 3.75 mm or about 7.25 mm along the length of the same. Further, it will be appreciated that projections 14 and guide notches 18 may be provided in any of a variety of suitable sizes, such that the projections 14 can be effectively received within the guide notches 18.

In another embodiment, the buffer tube insert 10, 110 can be formed of a variety of materials. In one specific configuration, the buffer tube insert 10, 110 can be formed of steel and titanium. It will be appreciated, however, that a buffer tube insert can be formed from any of a variety of suitable materials. In certain embodiments, the buffer tube insert 10 could further provide improved wear resistance in the buffer tube 20.

Figure 5:
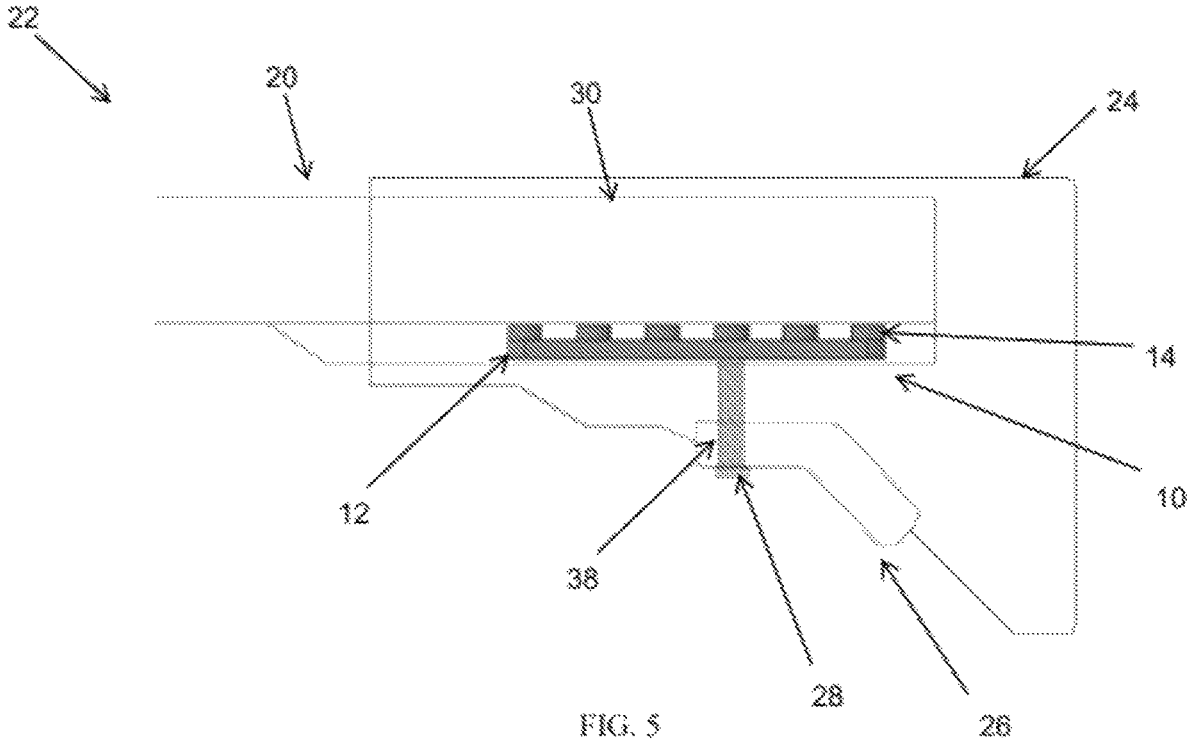
FIG. 5 depicts a schematic view of the buffer tube insert of FIG. 1, along with the buffer tube and set screw of FIG. 4, with a buffer tube position secured within a gunstock by the set screw.

As shown in FIG. 5, a gunstock assembly 22 can comprise a buffer tube 20 and a collapsible gunstock 24 including an adjustment mechanism 26, with a set screw 28. Generally, buffer tube 20 can be slidably housed within the collapsible gunstock 24 from a first position, in which a firearm is fully extended, and a second position, in which the firearm is collapsed. It will be appreciated, however, that in certain embodiments, a collapsible gunstock can be moved and secured at any position between a first position and a second position. The adjustment mechanism 26 of a collapsible gunstock 24 can be used to facilitate securement at such positions in association with the position guide notches 18.

Figure 4:
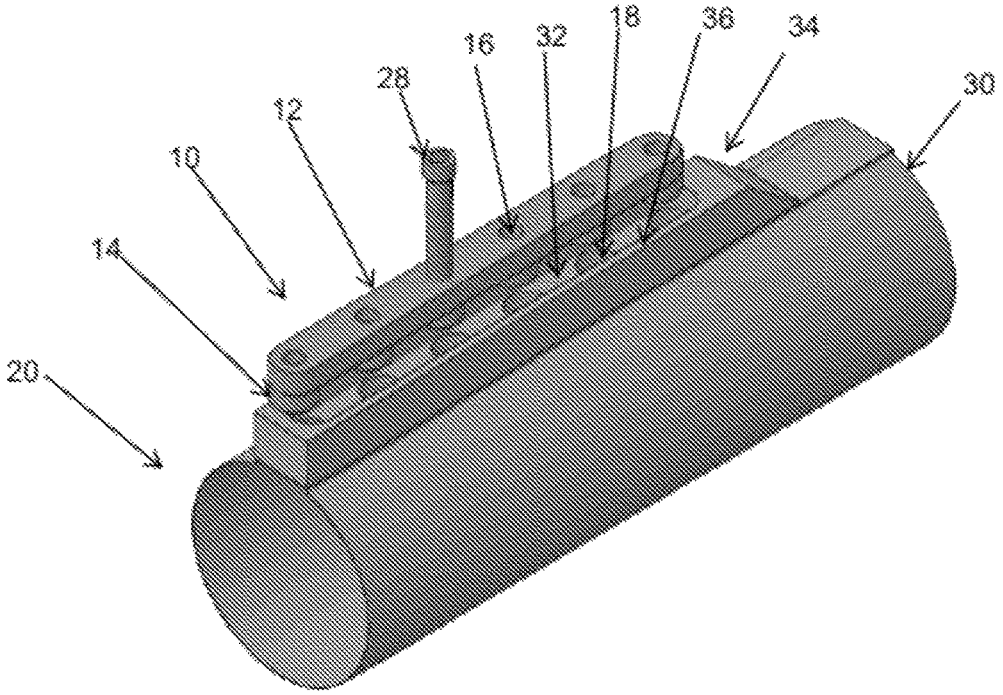
FIG. 4 depicts a perspective view of the buffer tube insert of FIG. 1 with a buffer tube and set screw.

In certain non-limiting embodiments, the buffer tube 20 can include an elongated tube portion 30 and a flat portion 32. The flat portion 32 can include the plurality of notches 18 and can be affixed to or integrated within an outer surface of the tube portion 30 of the buffer tube 20. As shown in FIG. 4, for example, the flat portion 32 can include a track 34 defined by a pair of rails 36, which can extend along at least a portion of a length of the elongated tube portion 30 and on both sides of the plurality of notches 18. In certain embodiments, the track 34 can be positioned on an underside of the buffer tube 20. A portion or all of the buffer tube insert 10 can be received between the rails 36, and one or more of the plurality of projections 14 of the buffer tube insert can be inserted into the notches 18 of the flat portion 32 of the buffer tube 20, such that the buffer tube insert fits securely within the buffer tube. In certain embodiments, the buffer tube insert 10 can be secured by a snug fit between the rails. In certain embodiments, the buffer tube insert 10 can be secured or held in place by an interior portion of the gunstock 24. In certain embodiments, all or a portion of the buffer tube insert 10 can rest on the top or one or both rails. It will be appreciated, however, that the buffer tube insert can be secured to or urged against a buffer tube, or otherwise held in place, by any of a variety of suitable devices or methods.

In certain non-limiting embodiments, the adjustment mechanism 26 can define an aperture 38 and be used with the set screw 28 to restrict movement of the gunstock 24. With the projections 14 of the buffer tube insert 10 secured within the notches 18 of the buffer tube 20, as shown in FIG. 5, the gunstock 24 can be positioned such that the aperture 38 within the adjustment mechanism 26 is in alignment with the threaded interior 16 of one of the plurality of projections 14 of the buffer tube insert 10. The set screw 28 can extend through the aperture 38 and into the threaded interior 16 for threaded connection with one of the plurality of projections 14, as the threaded interior 16 for each of the plurality of projections 14 can be configured to receive the set screw 28. Upon securement of the set screw 28 to the buffer tube insert 10, movement of the gunstock 24 relative to the buffer tube 20 is restricted. Accordingly, a collapsible gunstock can be converted to a fixed gunstock. As can be appreciated, the removal of the buffer tube insert causes the gunstock to again be collapsible. The set screw or some other type of connector can be configured to be removable or irremovable once inserted into a projection 14 of the buffer tube insert 10.

A non-limiting method of using the buffer tube insert 10 in accordance with the present disclosure can include positioning the buffer tube insert between the pair of rails 36 such that one or more of the plurality of projections 14 can be insert into one or more of the corresponding plurality of notches 18 on the buffer tube 20. Subsequently, a user can adjust the position of the gunstock 24 relative to the buffer tube 20, such that the aperture 38 of the adjustment mechanism 26 aligns with the threaded interior 16 of one of the plurality of projections 14. A user can further secure the set screw 28 extending through the aperture 38 within the threaded interior 16 to restrict movement of the gunstock. The set screw 28 can be removed by the user to allow the movement of the gunstock.

In various embodiments disclosed herein, a single component can be replaced by multiple components and multiple components can be replaced by a single component to perform a given function or functions. Except where such substitution would not be operative, such substitution is within the intended scope of the embodiments.

Additional features and methods of operation of buffer tube insert 10 are included in the figures.

A number of implementations have been described. Nevertheless, it will be understood that various modifications may be made without departing from the spirit and scope of the claims. Accordingly, other implementations are within the scope of the following claims.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

To aid the Patent Office and any readers of this application and any resulting patent in interpreting the claims appended hereto, Applicant does not intend any of the appended claims or claim elements to invoke 35 U.S.C. 112(f) unless the words "means for" or "step for" are explicitly used in the particular claim.

The invention claimed is:

1. A buffer tube insert, comprising:

an elongated portion; said elongated portion has a plurality of said projections arranged in series along a length of said elongated portion; and each of said projections extending from the elongated portion, each projection including an interior cavity; and wherein each of said projections is configured for insertion in a corresponding notch on a buffer tube of a firearm.

2. The buffer tube insert as defined in claim 1, wherein one or more of said projections is cylindrical or substantially cylindrical.

3. A buffer tube insert, comprising:

an elongated portion; said elongated portion includes 2-6 of said projections; and each of said projections extending from the elongated portion, each projection including an interior cavity; and wherein each of said projections is configured for insertion in a corresponding notch on a buffer tube of a firearm.

4. The buffer tube insert as defined in claim 1, wherein said cavity of each of said of projections is configured to include a connection member.

5. The buffer tube insert as defined in claim 4, wherein said connection member is releasably connected to said cavity.

6. The buffer tube insert as defined in claim 4, wherein said cavity includes a threaded cavity and said connection member is a threaded screw.

7. The buffer tube insert as defined in claim 1, wherein said buffer tube insert is configured to be received between rails extending from the buffer tube.

8. The buffer tube insert as defined in claim 7, wherein the rails extend from an underside of the buffer tube.

9. The buffer tube insert as defined in claim 1, wherein said elongated member and/or said one or more projections are formed of one or more materials selected from the group consisting of steel and titanium.

10. A gunstock assembly, comprising:

a collapsible gunstock including an adjustment mechanism;

a buffer tube slidably housed within the collapsible gunstock, the buffer tube comprising:

an elongated tube portion; said elongated portion has a plurality of said projections arranged in series along a length of said elongated portion; and a flat portion affixed to an outer surface of the tube, the flat portion including:

a track defined by two rails extending along at least a portion of a length of the elongated tube portion; and a plurality of notches arranged in series along at least a portion of a length of the flat portion between the two rails;

a buffer tube insert including:

an elongated portion; and one or more projections extending from the elongated portion, each projection including an interior cavity; and wherein each of said projections is configured for insertion in a corresponding notch on a buffer tube of a firearm;

a connection member configured for insertion into the adjustment mechanism and releasably connectable with one of said projections of the buffer tube insert.

11. A gunstock assembly comprising:

a collapsible gunstock that includes an adjustment mechanism;

a buffer tube slidably that is housed within said collapsible gunstock; said buffer tube includes:

an elongated tube portion; said elongated portion has a plurality of said projections arranged in series along a length of said elongated portion; and a flat portion affixed to an outer surface of said elongated tube portion; said flat portion includes:

a track that is defined by two rails that extend along at least a portion of a length of said elongated tube portion; and a plurality of notches that are arranged in series along at least a portion of a length of said flat portion between said two rails;

a buffer tube insert; said buffer tube inserts includes:

each of said projections extend from said elongated portion; each of said projections includes an interior cavity; one or more of said projections is cylindrical; and an elongated portion; said elongated portion has a plurality of said projections arranged in series along a length of said elongated portion; each of said projections is configured for insertion in a corresponding notch on a buffer tube of a firearm; said plurality of said projections extend from said elongated portion; and a connection member that is configured for insertion into said adjustment mechanism and is releasably connectable with at least one of said projections of said buffer tube insert.

12. A gunstock assembly comprising:

a collapsible gunstock that includes an adjustment mechanism;

a buffer tube slidably that is housed within said collapsible gunstock; said buffer tube includes:

an elongated tube portion; said elongated portion includes 2-6 of said projections; and a flat portion affixed to an outer surface of said elongated tube portion; said flat portion includes:

a track that is defined by two rails that extend along at least a portion of a length of said elongated tube portion; and a plurality of notches that are arranged in series along at least a portion of a length of said flat portion between said two rails;

a buffer tube insert; said buffer tube inserts includes:

one or more projections that extend from said elongated portion; each of said projections includes an interior cavity; one or more of said projections is cylindrical; and an elongated portion; said elongated portion has a plurality of said projections arranged in series along a length of said elongated portion; each of said projections is configured for insertion in a corresponding notch on a buffer tube of a firearm; said plurality of said projections extend from said elongated portion; and a connection member that is configured for insertion into said adjustment mechanism and is releasably connectable with at least one of said projections of said buffer tube insert.

13. The buffer tube insert as defined in claim 11, wherein said cavity of each of said of projections is configured to include a connection member; said connection member is releasably connected to said cavity; said cavity includes a threaded cavity and said connection member is a threaded screw.

14. The buffer tube insert as defined in claim 11, wherein said rails extend from an underside of said buffer tube.

15. The buffer tube insert as defined in claim 11, wherein said elongated member and/or said one or more projections are formed of one or more materials selected from the group consisting of steel and titanium.

* * * * *